US009520656B2

(12) United States Patent
Kakimi et al.

(10) Patent No.: US 9,520,656 B2
(45) Date of Patent: Dec. 13, 2016

(54) ROUND TERMINAL FIXATION STRUCTURE

(71) Applicant: Yazaki Corporation, Tokyo (JP)

(72) Inventors: Takaaki Kakimi, Makinohara (JP); Hiroaki Yamada, Makinohara (JP)

(73) Assignee: Yazaki Corporation, Tokyo (JP)

( * ) Notice: Subject to any disclaimer, the term of this patent is extended or adjusted under 35 U.S.C. 154(b) by 20 days.

(21) Appl. No.: 14/267,108

(22) Filed: May 1, 2014

(65) Prior Publication Data

US 2014/0335743 A1 Nov. 13, 2014

(30) Foreign Application Priority Data

May 9, 2013 (JP) ..... 2013-099189

(51) Int. Cl.

| | |
|---|---|
| ***H01R 4/44*** | (2006.01) |
| ***H01R 4/30*** | (2006.01) |
| ***H01R 4/34*** | (2006.01) |
| *H01R 4/18* | (2006.01) |
| *H01R 11/12* | (2006.01) |

(52) U.S. Cl.

CPC ..... *H01R 4/30* (2013.01); *H01R 4/305* (2013.01); *H01R 4/34* (2013.01); *H01R 4/185* (2013.01); *H01R 11/12* (2013.01)

(58) Field of Classification Search

CPC ..... H01R 4/70; H01R 4/30; H01R 4/34
USPC ..... 439/810, 781, 868, 883
See application file for complete search history.

(56) References Cited

U.S. PATENT DOCUMENTS

| | | | | |
|---|---|---|---|---|
| 5,510,960 | A * | 4/1996 | Rosen | H01R 9/2425 361/624 |
| 6,089,930 | A * | 7/2000 | Matsuoka | H01R 4/30 439/883 |
| 6,388,216 | B1 * | 5/2002 | Puhalla | H01H 1/42 200/254 |
| 6,725,524 | B2 * | 4/2004 | Lin | H02K 5/225 29/596 |
| 7,004,798 | B2 * | 2/2006 | Yuasa | H01R 4/62 439/874 |
| 7,160,157 | B1 * | 1/2007 | Jones, III | H01R 11/11 439/288 |
| 7,581,966 | B2 * | 9/2009 | Shigehisa | H01R 4/185 439/98 |

(Continued)

FOREIGN PATENT DOCUMENTS

JP 2004-127704 A 4/2004

*Primary Examiner* — Abdullah Riyami
*Assistant Examiner* — Nader Alhawamdeh
(74) *Attorney, Agent, or Firm* — Locke Lord LLP

(57) ABSTRACT

A round terminal fixation structure is a structure for fixing a round terminal connected to an end of an electric wire to a bus bar in an overlapping manner with a bolt. The round terminal includes: a bolt insertion portion with a first through-hole into which the bolt is inserted; a core wire crimp portion for crimping a core wire of the electric wire; and an insulating cover crimp portion. The bus bar includes: a flat plate portion with a second through-hole; a pair of standing pieces vertically extended from the flat plate portion for positioning the core wire crimp portion in between the pair of standing pieces while the first and second through-holes are overlapped with each other; and connection portions electrically connected to the relay or the fuse. A gap between the pair of standing pieces is formed smaller than a width of the bolt insertion portion.

3 Claims, 19 Drawing Sheets

(56) References Cited

U.S. PATENT DOCUMENTS

| | | | | |
|---|---|---|---|---|
| 8,647,160 | B2 * | 2/2014 | Umemoto | H01R 13/113 439/845 |
| 9,106,007 | B2 * | 8/2015 | Makino | H01R 9/16 |
| 2004/0048524 | A1 * | 3/2004 | Yuasa | H01R 4/62 439/891 |
| 2007/0264865 | A1 * | 11/2007 | Hagikura | H01R 4/30 439/493 |
| 2012/0100731 | A1 * | 4/2012 | Umemoto | H01R 13/113 439/86 |
| 2014/0154897 | A1 * | 6/2014 | Makino | H01R 9/16 439/76.2 |
| 2014/0220420 | A1 * | 8/2014 | Yoshioka | H01M 2/10 429/158 |

* cited by examiner

ROUND TERMINAL FIXATION STRUCTURE

CROSS REFERENCE TO RELATED APPLICATIONS

This application is on the basis of Japanese Patent Application No. 2013-099189, the contents of which are hereby incorporated by reference. Also, this application is related to co-pending application: "ROUND TERMINAL FIXATION STRUCTURE" filed even date herewith in the names of Sunsoku I and Takaaki Kakimi which claims priority to Japanese Application No. 2013-099190 filed May 9, 2013, application is assigned to the assignee of the present application.

TECHNICAL FIELD

The present invention relates to a round terminal fixation structure for fixing a round terminal connected to an end of an electric wire to a bus bar in an overlapping manner with a bolt.

BACKGROUND ART

The above round terminal fixation structure is used for example in an on-vehicle electrical junction box (see PTL 1). FIG. 15 is a perspective view showing a main part of an junction box electrical junction box using a conventional round terminal fixation structure. FIG. 16 is a perspective view show the round terminal fixation structure shown in FIG. 15. FIG. 17 is a perspective view showing a state before the round terminal is fixed to the electrical junction box shown in FIG. 15. FIG. 18 is a bottom view showing the electrical junction box shown in FIG. 17. FIG. 19 is an explanatory view showing an operation for fixing the round terminal to a bus bar shown in FIG. 17.

A round terminal fixation structure 301 shown in FIG. 15 is configured to fix a round terminal 3 (also referred to as LA terminal) connected to an end of an electric wire 2 to a bus bar 304 shown in FIGS. 17 to 19 in an overlapping manner with a bolt 5. Further, FIG. 15 shows a main part of an on electrical junction box 310 using the round terminal fixation structure 301.

In FIGS. 15 and 17 to 19, a reference sign 8 denotes a block made of synthetic resin. The bus bar 304, a nut 7 to which the bolt 5 is screwed and a not-shown plurality of components such as a relay and a fuse are attached to this block 8. A portion of the bus bar 304 is exposed at a terminal connection portion 80 of the block 8, and the round terminal 3 is overlapped with this exposed portion. In FIG. 15, an arrow B denotes a rotation direction of the bolt 5 upon screwing with the nut 7.

As shown in FIG. 16 (in FIG. 16, an illustration of the block 8 is omitted), the round terminal 3 includes: a bolt insertion portion 31 provided with a first through-hole 30 through which the bolt 5 is passed; a core wire crimp portion 32 for crimping a core wire 21 of the electric wire 2; and an insulating cover crimp portion 33 for crimping an insulating cover 22 of the electric wire 2.

As shown in FIG. 16, the bus bar 304 includes: a flat plate portion 341 provided with a second through-hole 340 through which the bolt 5 is passed; a rotation restriction piece 342 vertically extending from the flat plate portion 341 to restrict the rotation of the round terminal 3 when tightening the bolt 5, and a plurality of connection portions (not shown) electrically connected to the relay or the fuse.

As shown in FIG. 19, in such round terminal fixation structure 301, the round terminal 3 is inserted into the block 8 and overlapped with the terminal connection portion 80 of the bus bar 304, and the bolt 5 having a washer 6 is inserted into the first through-hole 30, the second through-hole 340 and the nut 7, and then the bolt 5 is rotated in the B direction (see FIG. 15) to be screwed with the nut 7, thereby the round, terminal 3 is fixed to the bus bar 304 and the round terminal 3 is electrically connected to the bus bar 304.

CITATION LIST

Patent Literature

PTL 1: JP, A, 2004-127704

SUMMARY OF INVENTION

Technical Problem

However, the conventional round terminal fixation structure 301 described above has several problems as explained below.

First, as shown in FIGS. 20 and 21, the bolt 5 can be fastened while the round terminal 3 is not set in a regular position, namely, the first through-hole 30 is not overlapped with the second through-hole 340. Thus, because the bus bar 304 and the round terminal 3 conduct with each other in a following continuity check, there is a problem that an assembling failure may be overlooked.

Further, as shown in FIGS. 22 and 23, if the bolt 5 is accidentally tightened while the round terminal 3 is located over the rotation restriction piece 342, there is a problem that the round terminal 3 may be fixed in a deformed state as shown by a dotted line in FIG. 23. In this case also, because the bus bar 304 and the round terminal 3 conduct with each other in a following continuity check, there is a problem that an assembling failure may be overlooked.

Further, the rotation restriction piece 342 needs a certain height for surely restricting a rotation of the round terminal 3. As shown in FIG. 18, the height of the rotation restriction piece 342 is H2, and if the height is higher than H2, the rotation of the round terminal 3 is further surely restricted. However, if the height of the rotation restriction piece 342 becomes higher, a space between a wall surrounding the terminal connection portion 80 of the block 8 and a distal end of the rotation restriction piece 342 (i.e. the space denoted by a meshed portion S in FIG. 18) becomes narrower, and there problem that it may become hard to insert the round terminal 3 into this space.

Accordingly, an object of the present invention is to provide a round terminal fixation structure in which a round terminal can be easily set at a regular position and which can prevent an assembling failure.

Solution to Problem

For attaining the object, according to a first aspect of the present invention, there is provided a round terminal fixation structure including:

a round terminal connected to an end of an electric wire; and a bus bar to which the round terminal is configured to be fixed in an overlapping manner with a bolt, wherein the round terminal includes: a bolt insertion portion provided with a first through-hole through which the bolt is inserted; and a core wire crimp portion crimping a core wire of the electric wire, wherein the bus bar includes: a flat plate portion provided with a second through-hole through which the bolt is inserted; and a pair of standing pieces vertically extending from the flat plate portion and configured to position the core wire crimp portion in between the pair of standing; pieces while the first and second through-holes are overlapped with each other, and wherein a gap between the pair of standing pieces is formed smaller than a width of the bolt insertion portion.

According to a second aspect of the present invention, there is provided the round terminal fixation structure as described in the first aspect, wherein a distal end of at least one of the pair of standing pieces is inclined toward the flat plate portion as extended away from the second through-hole.

According to a third aspect of the present invention, there is provided the round terminal fixation structure as described in the second aspect, wherein a distal end of the other one of the pair of standing pieces is also inclined toward the flat plate portion as extended away from the second through-hole.

Advantageous Effects of Invention

According to the invention described in the first aspect, because the core wire crimp portion is positioned in between the pair of standing pieces, the round terminal can be easily set at the regular position. Further, when the core wire crimp portion is positioned in between the pair of standing pieces, the round terminal is moved by at least a height of the standing pieces from the distal end of the standing pieces toward the flat plate portion. Therefore, an operator can obtain a feeling of catching the core wire crimp portion in between the pair of standing pieces, and owing to this feeling, can understand that the round terminal is set at the regular position. Thereby, the assembling failure is prevented.

According to the invention described in the second aspect, even if the bolt is accidently tightened while the round terminal is located over the inclined standing piece, the round terminal is moved downward in a direction away from the second through hole as the bolt is tightened. Thereby, the round terminal can be prevented from being fixed in the deformed state.

According to the invention described in the third aspect, because the both distal ends of the pair of standing pieces are inclined, despite the large height of the standing pieces, the round terminal is moved from the standing pieces to the second through-hole to set at the regular position without being interrupted by the standing pieces. Thereby, the round terminal can be easily set at the regular position.

These and other objects, features, and advantages of the present invention will become more apparent upon reading of the following detailed description along with the accompanied drawings.

DESCRIPTION OF EMBODIMENTS (First Embodiment)

A round terminal fixation structure according to a first embodiment of the present invention and an electrical junction box using the round terminal fixation structure will be explained with reference to FIGS. 1 to 9.

Figure 1:
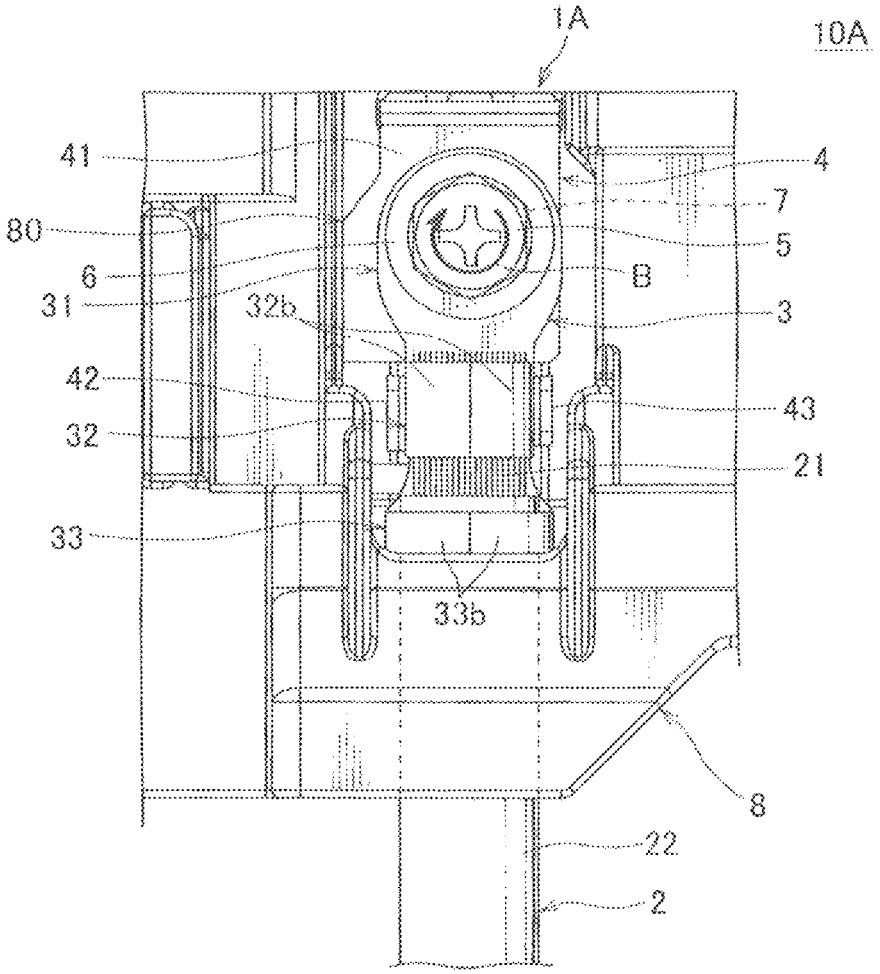
FIG. 1 is a side view of an electrical junction box using a round terminal fixation structure according to a first embodiment of the present invention.
Figure 4:
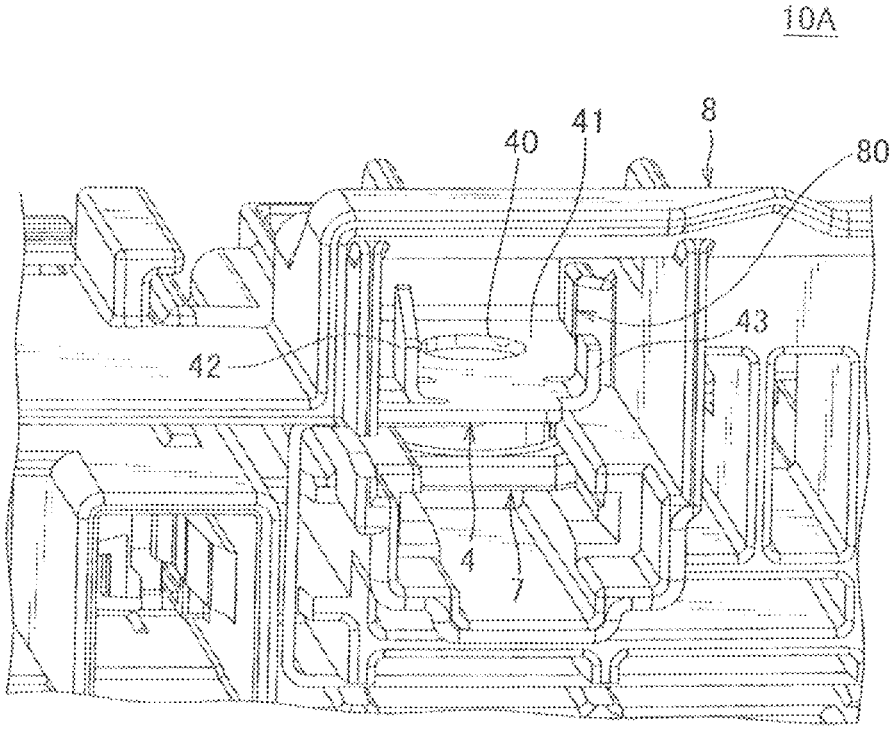
FIG. 4 is a perspective view showing a state before the round terminal is fixed to the electrical junction box shown in FIG. 1.
Figure 5:
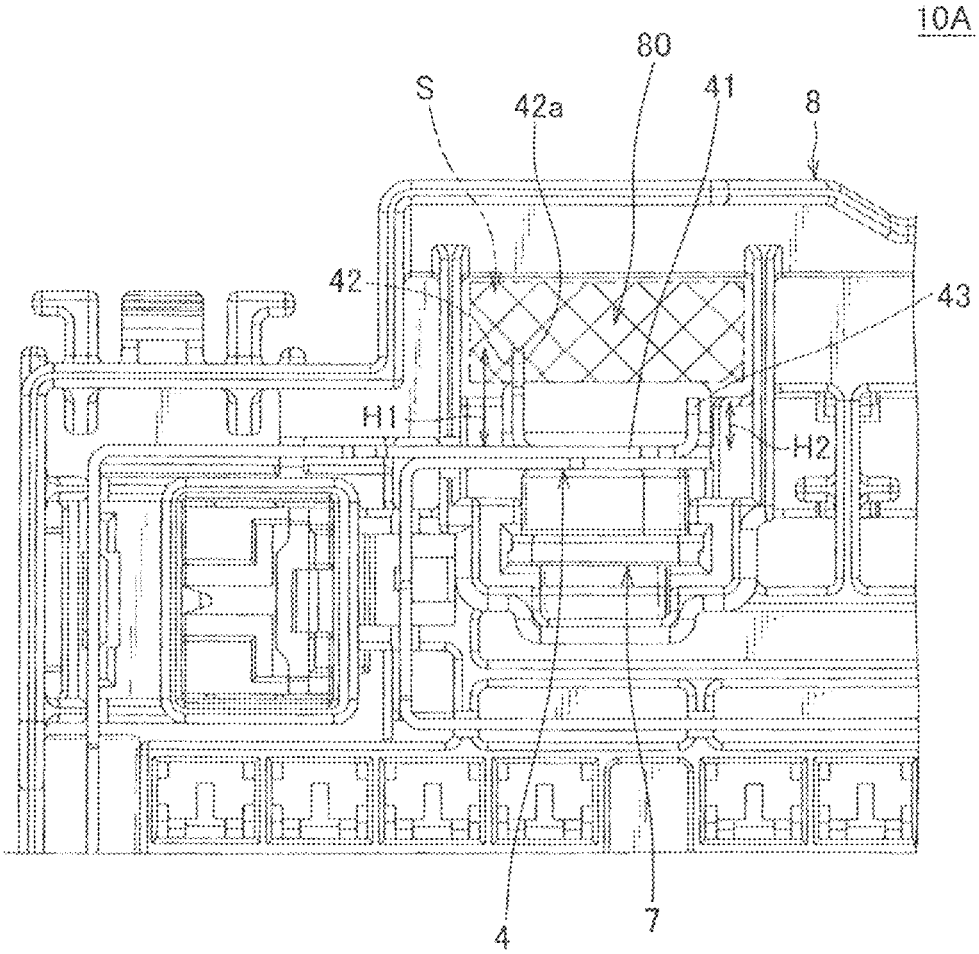
FIG. 5 is a bottom view of the electrical junction box shown in FIG. 4.
Figure 6:
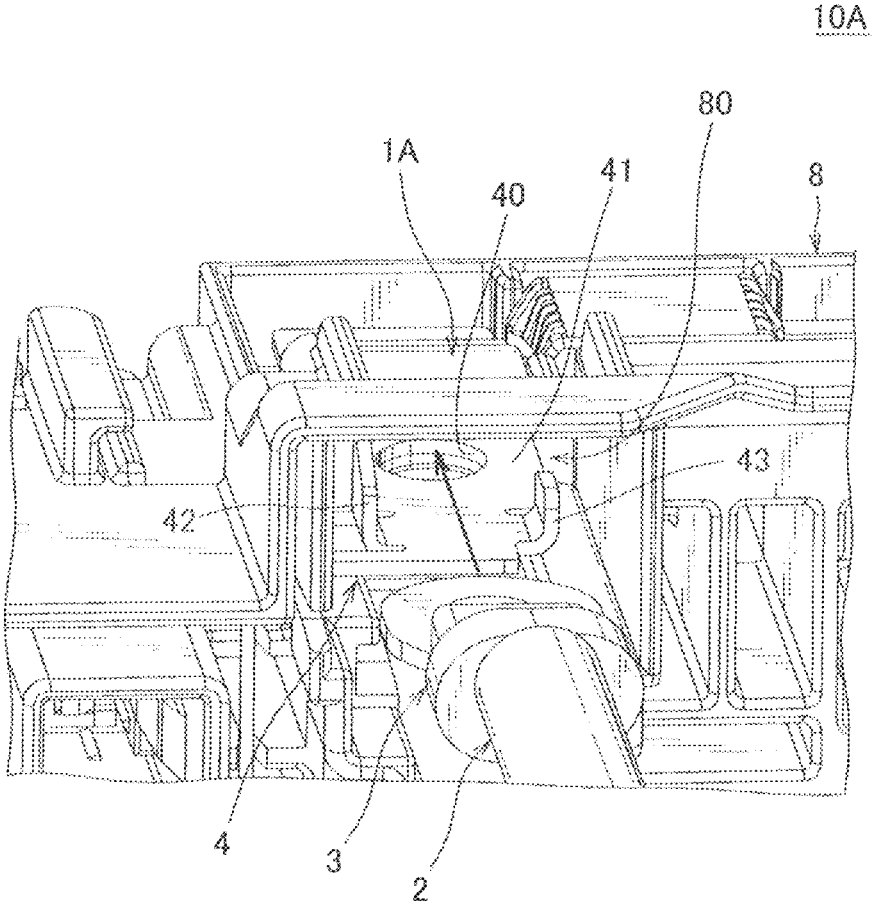
FIG. 6 is an explanatory view showing an operation of fixing the round terminal to the bus bar shown in FIG. 4.

A round terminal fixation structure 1A shown in FIG. 1 is a structure for fixing a round terminal 3 (also referred to as LA terminal) connected to an end of an electric wire 2 to a bus bar 4 shown in FIGS. 4 to 6 in an overlapping manner with a bolt 5. Further, FIG. 1 shows a main part of an on-vehicle electrical junction box 10A using the round terminal fixation structure 1A.

In FIGS. 1 and 4 to 6, a reference sign 8 denotes a block made of synthetic resin. The bus bar 4, a nut 7 to which the bolt 5 is screwed and a not-shown plurality of components such as a relay and a fuse are attached to this block 8.

Further, in FIGS. 1 and 4 to 6, a reference sign 80 denotes a terminal connection portion of the block 8. The bus bar 4 and the round terminal 3 are overlapped with each other at this terminal connection portion 80 and fixed together by the bolt 5 and the nut 7, thereby electrically connected to each other. In FIG. 1, an arrow B denotes a rotation direction of the bolt 5 upon screwing the bolt 5 to the nut 7. Further, the terminal connection portion 80 is surrounded by a tubular wall which is a part of the block 8. This tubular wall is provided with an opening portion for exposing a connection portion of the bus bar 4 and the round terminal 3.

Figure 2:
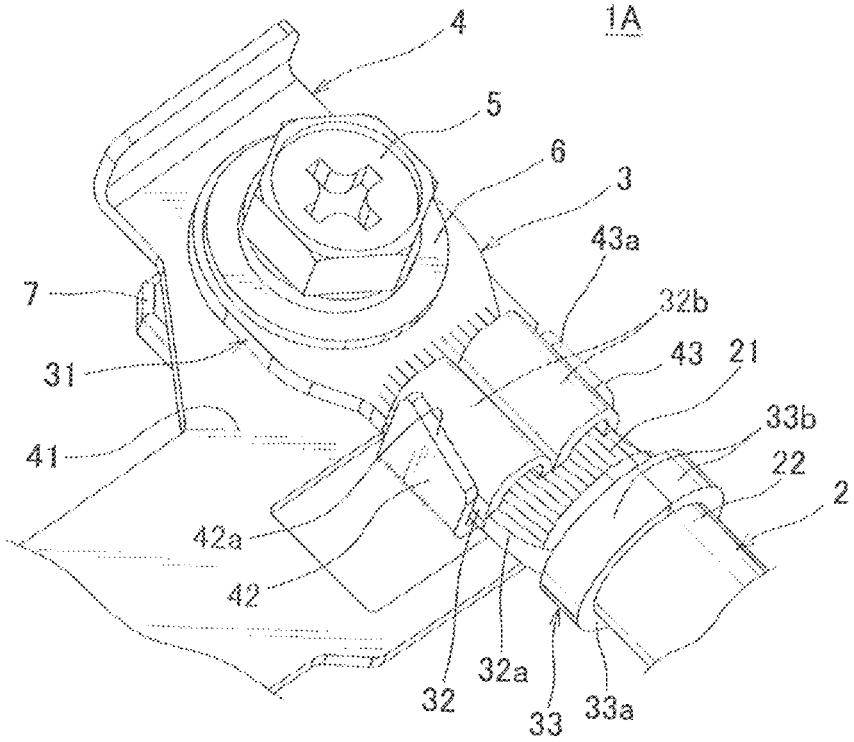
FIG. 2 is a perspective view of the round terminal fixation structure shown in FIG. 1.
Figure 7:
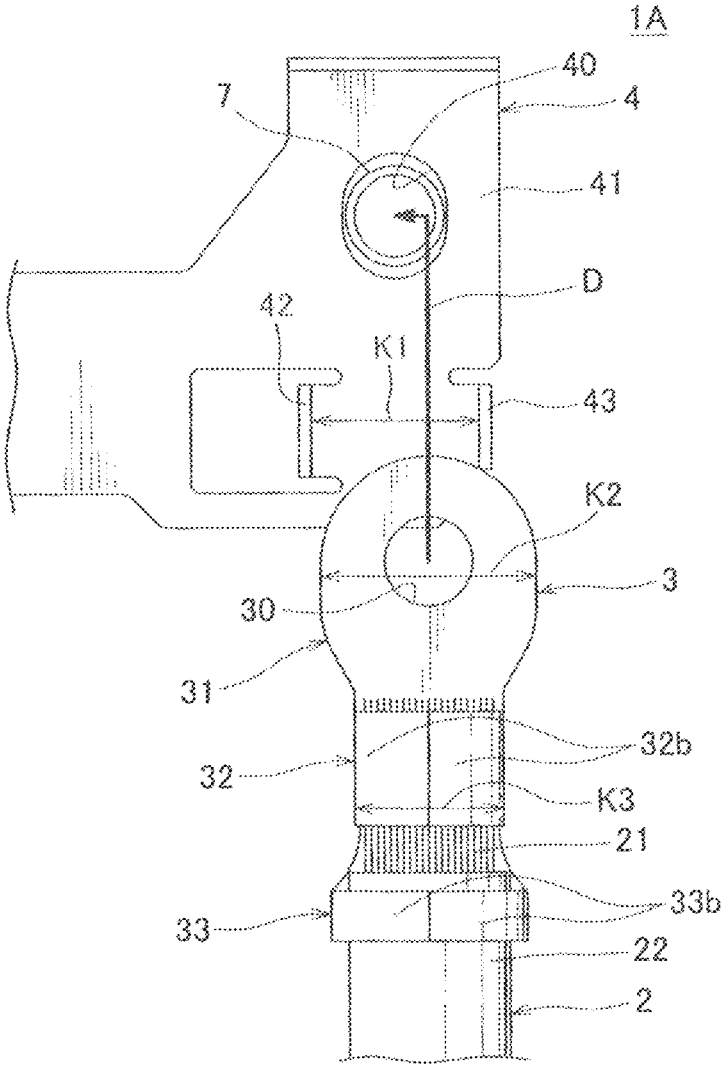
FIG. 7 is an explanatory view showing the operation of fixing the round terminal to the bus bar shown in FIG. 4 similar to FIG. 6.

The round terminal 3 is made by pressing a metal plate. As shown in FIGS. 2 and 7, the round terminal 3 includes: a bolt insertion portion 31 provided with a first through-hole 30 into which the bolt 5 is inserted; a core wire crimp portion 32 for crimping a core wire 21 of the electric wire 2; and an insulating cover crimp portion 33 for crimping an insulating cover 22 of the electric wire 2. The bolt insertion portion 31 is formed into a plate having a substantially circular shape in a plan view, and the first through-hole 30 is formed at a center of the bolt insertion portion 31. The core wire crimp portion 32 includes: a base wall 32*a* continued to the bolt insertion portion 31; and a pair of crimp pieces 32*b* extended upward from both edges of the base wail 32*a*. The insulating cover crimp portion 33 includes: a base wall 33*a* continued to the base wall 32*a* and a pair of crimp pieces 33*b* extended upward from both edges of the base wall 33*a*.

Figure 3:
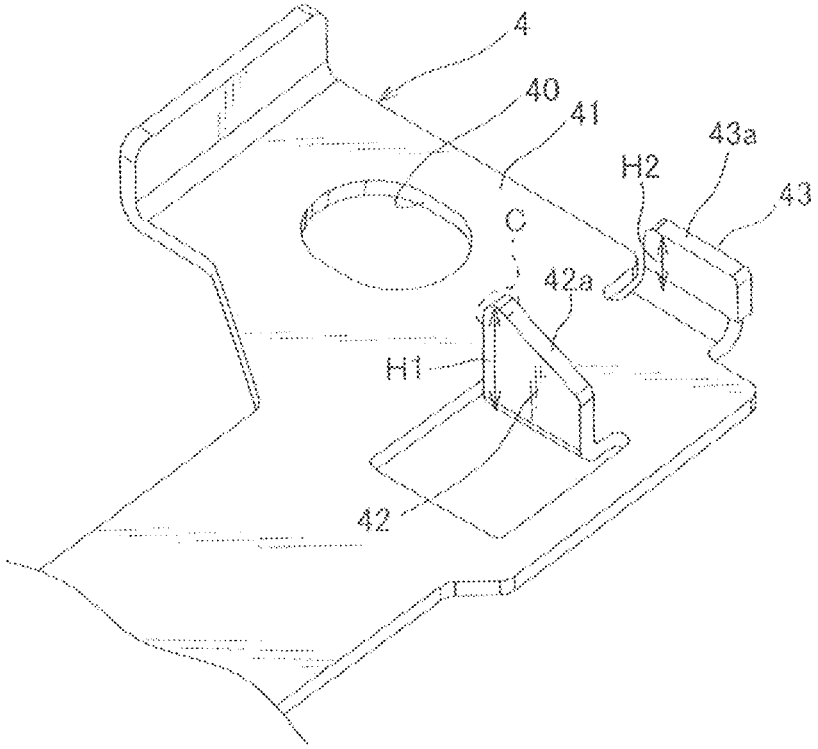
FIG. 3 is a perspective view showing only a bus bar shown in FIG. 2.

The bus bar 4 is made by pressing a metal plate. As shown in FIG. 3, the bus bar 4 includes: a flat plate portion 41 provided with a second through-hole 40 into which the bolt 5 is inserted; a pair of standing pieces 42, 43 vertically extended from the flat plate portion 41 and configured to position the core wire crimp portion in between the pair of standing pieces while the first and second through-holes are overlapped with each other; and a plurality of connection portions (not shown) electrically connected to the relay or the fuse mentioned above.

A gap (denoted by K1 in FIG. 7) between the pair of standing pieces 42, 43 is formed smaller than a width (denoted by K2 in FIG. 7) of the bolt insertion portion 31. Further, a width (denoted by K3 in FIG. 7) of the core wire crimp portion 32 is formed smaller than the width of the bolt insertion portion 31, and smaller than the gap between the pair of standing pieces 42, 43.

A distal end 42*a* of the one standing piece 42 of the pair of standing pieces 42, 43 is inclined toward the flat plate portion 41 as extended away from the second through-hole 40. A distal end 43*a* of the other standing piece 43 is parallel to the flat plate portion 41. Further, the distal end 43*a* of the other standing piece 43 is arranged nearer the flat plate portion 41 than the closest portion (denoted by C in FIG. 3) to the second through-hole 40 at the distal end 42*a* of the one standing piece 42. Namely, a height (denoted by H2 in FIG. 3) of the other standing piece 43 is formed lower than a height (denoted by H1 in FIG. 3) of the closest portion to the second through-hole 40 of the one standing piece 42.

Figure 8:
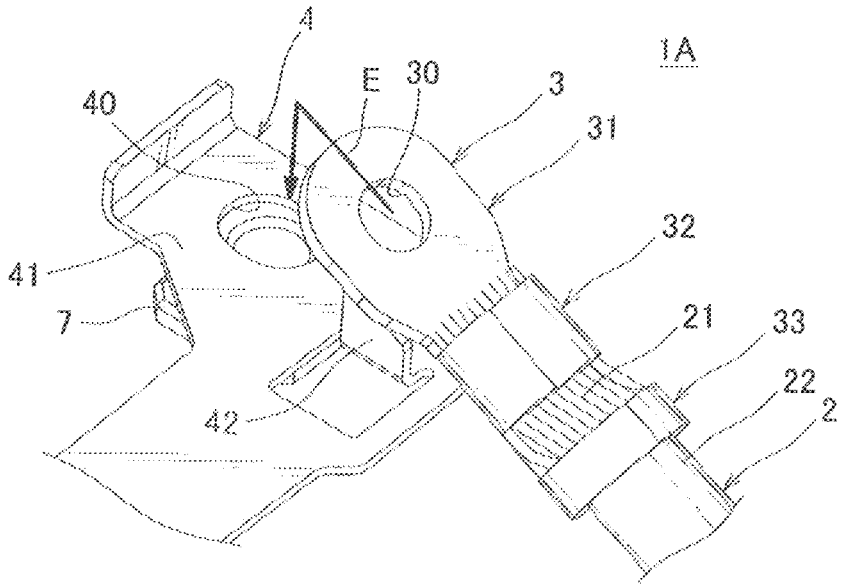
FIG. 8 is an explanatory view showing the operation of fixing the round terminal to the bus bar shown in FIG. 4 with a different manner from that of FIG. 7.

In the above round terminal, fixation structure 1A, when the round terminal 3 is fixed to the bus bar 4, an operation is performed under a procedure shown in FIGS. 6 and 7, or a procedure shown in FIGS. 6 and 8. Further, in FIGS. 7 and 8, though the block 8 is not illustrated, when the round terminal 3 is fixed to the bus bar 4, the bus bar 4 and the nut 7 are previously attached to the block 8 as shown in FIG. 6.

First, the procedure shown in FIGS. 6 and 7 will be explained. Previously the round terminal 3 is connected to an end of the electric wire 2, and as shown in FIG. 6, the round terminal 3 is inserted into the block 8, and then moved in an arrow D direction in FIG. 7. At this time, a rear surface of the bolt insertion portion 31 is slidably moved to the distal end 43*a* of the standing piece 43, and when the bolt insertion portion 31 is passed over the distal end 43*a*, the bolt insertion portion 31 is slightly moved toward the standing piece 42. Thereby, the core wire crimp portion 32 is positioned in between the pair of standing pieces 42, 43, and the first through-hole 30 is overlapped with the second through-hole 40. Namely the round terminal 3 is set at the regular position. Further, when the core wire crimp portion 32 is positioned in between the pair of standing pieces 42, 43, the round terminal 3 is moved by the height (H2) of the standing piece 43 from the standing piece 43 toward the flat plate portion 41. Thereby, an operator obtains a feeling of catching the core wire crimp portion 32 in between the pair of standing pieces 42, 43, and owing to this feeling, can understand that the round terminal 3 is set at the regular position. Thereby the assembling failure is prevented. Subsequently, the bolt 5 previously inserted into a washer 6 is inserted into the first through-hole 30, the second through-hole 40, and the nut 7, and screwed to finish a fixation operation of the round terminal 3.

Next, a procedure shown in FIGS. 6 and 8 will be explained. Previously the round terminal 3 is connected to an end of the electric wire 2, and as shown in FIG. 6, the round terminal 3 is inserted into the block 8, and then moved in an arrow E direction in FIG. 8. At this time, a rear surface of the bolt insertion portion 31 is slidably moved to the distal end 42*a* of the standing piece 42, and when the bolt insertion portion 31 is passed over the distal end 42*a*, the bolt insertion portion 31 is slightly moved toward the standing piece 43. Thereby, the core wire crimp portion 32 is positioned in between the pair of standing pieces 42, 43, and the first through-hole 30 is overlapped with the second through-hole 40. Namely, the round terminal 3 is set at the regular position. Further, when the core wire crimp portion 32 is positioned in between the pair of standing pieces 42, 43, the round terminal 3 is moved by the height (H1) of the standing piece 42 from the standing piece 42 toward the flat plate portion 41. Thereby, an operator obtains a feeling of catching the core wire crimp portion 32 in between the pair of standing pieces 42, 43, and owing to this feeling, can understand that the round terminal 3 is set at the regular position. Thereby, the assembling failure is prevented. Subsequently, the bolt 5 previously inserted into a washer 6 is inserted into the first through-hole 30, the second through-hole 40, and the nut 7, and screwed to finish a fixation operation of the round terminal 3.

Incidentally, in the procedures shown in FIGS. 6 to 8, the feeling of catching the core wire crimp portion 32 in between the pair of standing pieces 42, 43 is further surely attained when the bolt insertion portion 31 is slidably moved on the inclined distal end 42*a* than the flat distal end 43*a* because of its height. However, because a travel distance is smaller when the bolt insertion portion 31 is slidably moved on the flat distal end 43*a* than on the inclined distal end 42*a*, a level of fatigue of the operator is smaller in this way.

Further, in the above procedures, when the round terminal 3 is inserted into the block 8, because the distal end 42*a* of the standing piece 42 is inclined toward the flat plate portion 41 as extended away from the second through-hole 40, the round terminal 3 can be easily inserted without being interrupted by the standing piece 42. This is applied to any of the two procedures.

Namely, as shown in FIG. 5, the height H1 (the height of the highest part) of the one standing piece 42 is formed higher than the height H2 of the other standing piece 43. Here, if the distal end 42*a* of the standing piece 42 is not inclined, the round terminal 3 needs to be inserted through a narrow space between the wall surrounding the terminal connection portion 80 of the block 8 and the non-inclined distal end 42*a* of the standing piece 42, thereby the workability is reduced. However, according to this embodiment, the standing piece 42 is configured such that the distal end 42*a* thereof is inclined toward the flat plate portion 41 as extended away from the second thorough hole 40. Therefore, the round terminal 3 can be inserted from a wide space formed between the wall surrounding the terminal connection portion 80 of the block 8 and a part of the distal end 42*a* of the standing piece 42 located most distant from the second through-hole 40 (i.e. a space denoted by a meshed portion S FIG. 5). Consequently, despite the large height of the standing piece 42, the round terminal 3 can be easily set at the regular position without being interrupted by the standing piece 42 during the insertion of the round terminal 3 into the block 8.

Figure 9:
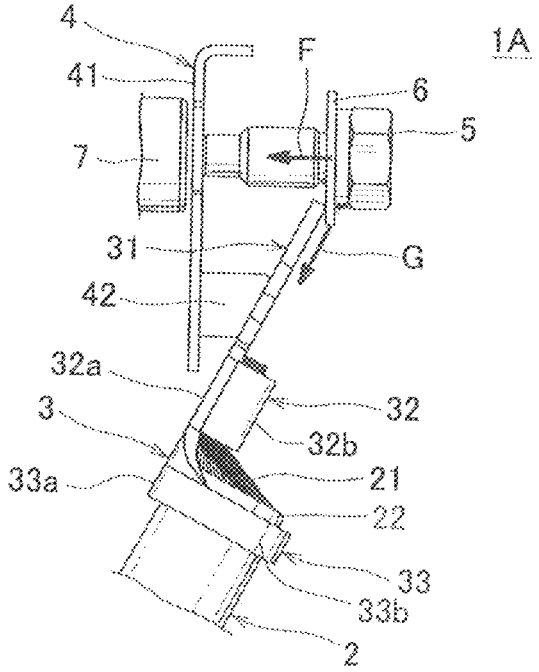
FIG. 9 is an explanatory view showing a function effect of the round terminal fixation structure shown in FIG. 1.

Further, in the round terminal fixation structure 1A, occasionally, the round terminal 3 which has once been installed at the regular position may be displaced before tightening the bolt 5, or the bolt 5 may be tightened while the round terminal 3 is not set at the regular position from the beginning. For example, as shown in FIG. 9, if the bolt 5 is accidently tightened while the round terminal 3 is located over the standing piece 42, then, as the bolt 5 is tightened (i.e. moved in an arrow F direction), the round terminal 3 is pushed by the washer 6 and moved downward in a direction away from the second through-hole 40 (an arrow G direction), thereby the round terminal 3 cannot be fixed. Namely, in the round terminal fixation structure 1A, the round terminal 3 can be prevented from being fixed in a deformed state. Further, because the bus bar 4 and the round terminal 3 do not conduct with each other in a later continuity test, the assembling failure can be detected.

Figure 18:
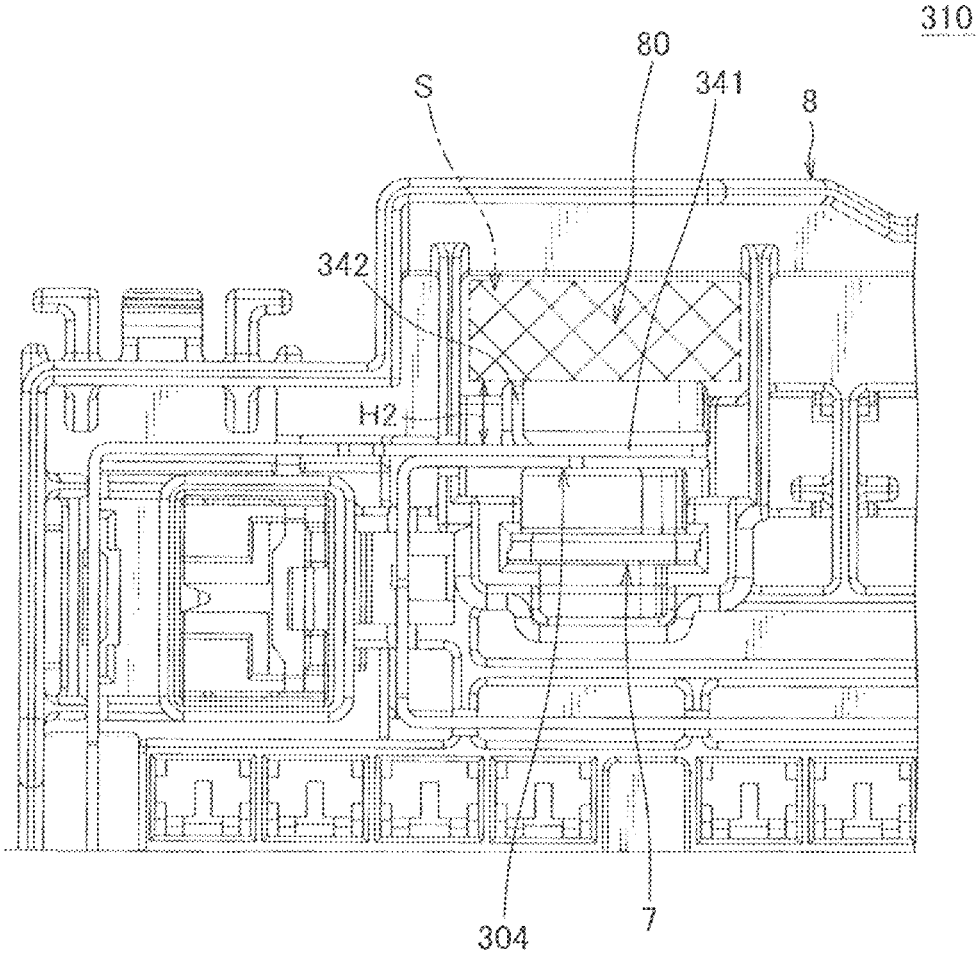
FIG. 18 PRIOR ART
FIG. 18 is a bottom view showing the electrical junction box shown in FIG. 17.
Figure 19:
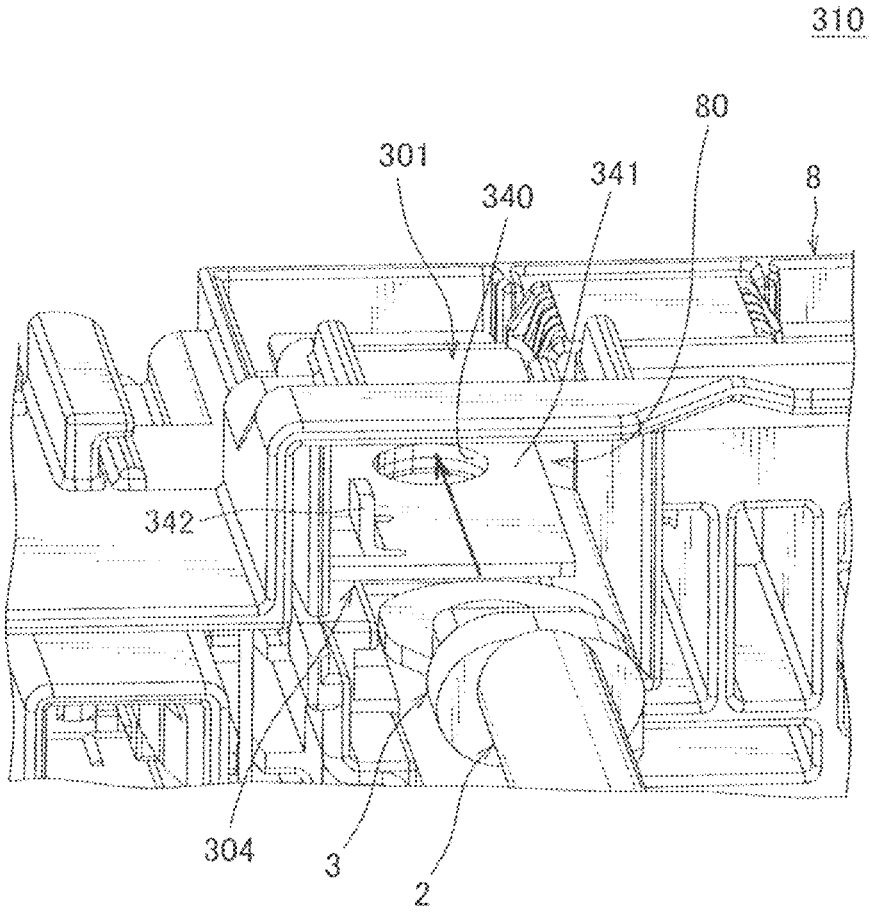
FIG. 19 PRIOR ART
FIG. 19 is an explanatory view showing an operation for fixing the round terminal to a bus her shown in FIG. 17.
Figure 20:
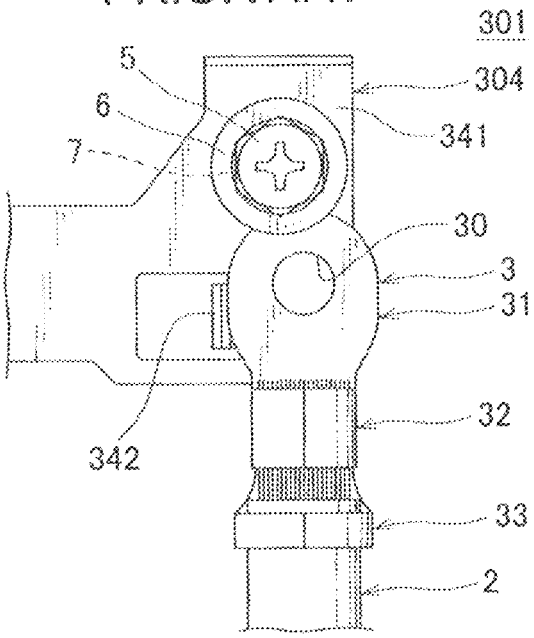
FIG. 20 PRIOR ART
FIG. 20 is an explanatory view for explaining a problem that may occur in the round terminal fixation structure shown in FIG. 15.
Figure 21:
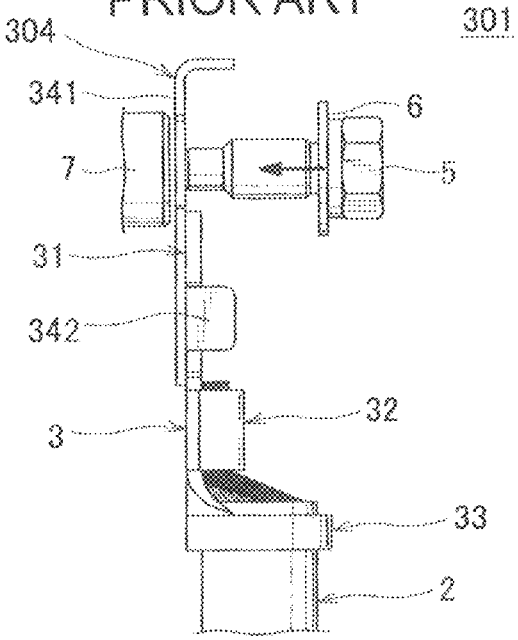
FIG. 21 PRIOR ART
FIG. 21 is a side view of the round terminal fixation structure shown in FIG. 20.
Figure 22:
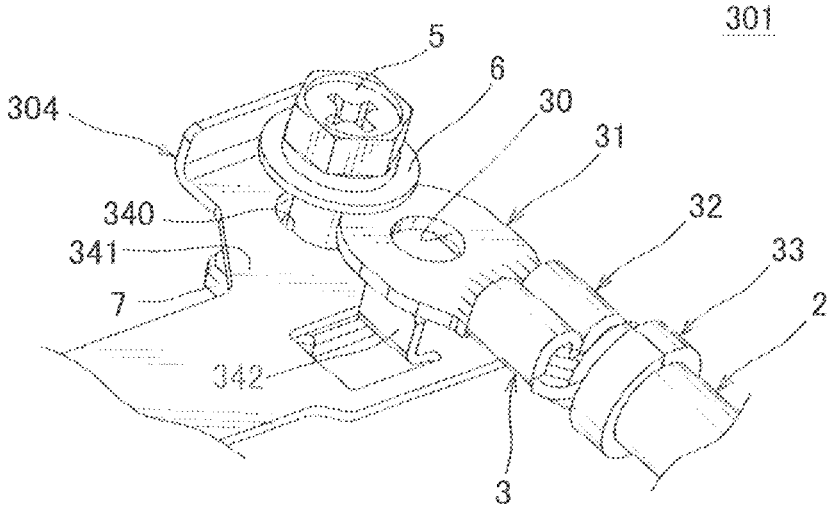
FIG. 22 PRIOR ART
FIG. 22 is an explanatory view for explaining another problem that may occur in the round terminal fixation structure shown in FIG. 15.
Figure 23:
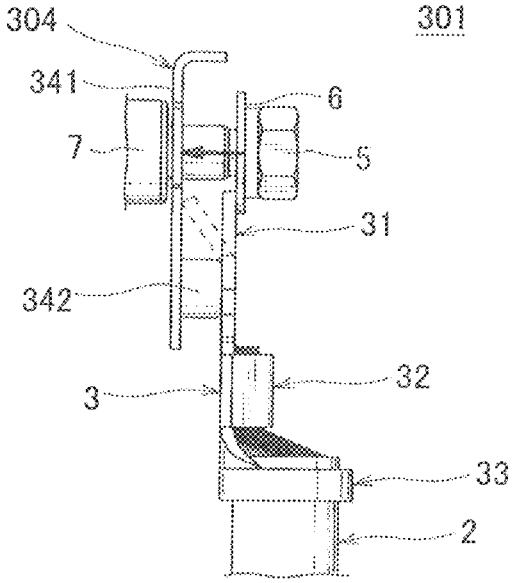
FIG. 23 PRIOR ART
FIG. 23 is a side view of the round terminal fixation structure shown in FIG. 22.

Further, the above standing piece 42 not only positions the round terminal 3 at the regular position, but also prevents a rotation of the round terminal 3 during tightening the bolt 5. Because the height of the standing piece 42 is higher than a conventional rotation prevention piece (see FIG. 18), the rotation of the round terminal 3 is surely prevented.

Further, according to the round terminal fixation structure 1A, the distal end 42*a* of the standing piece 42 positioned at a left side in FIG. 1 of the pair of standing pieces 42, 43 is inclined. However, according to the present invention, any one of the pair of standing pieces may be inclined.

(Second Embodiment)

A round terminal fixation structure according to a second embodiment of the present invention and an electrical junction box using this round terminal fixation structure will be explained with reference to FIGS. 10 to 14. In FIGS. 10 to 14, the same components as the first embodiment are denoted by the same reference signs, and explanations thereof are omitted.

Figure 10:
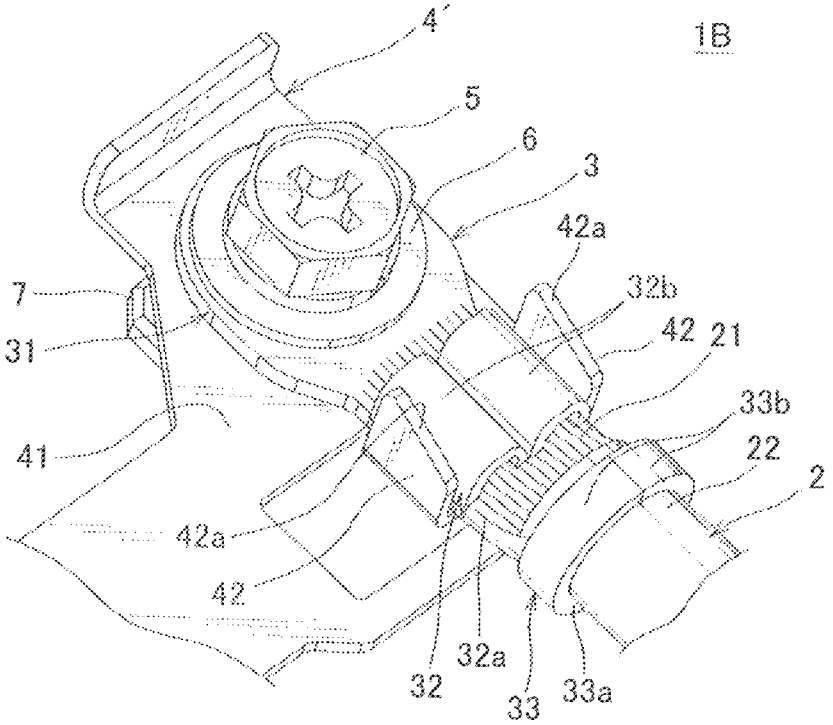
FIG. 10 is a perspective view showing a round terminal fixation structure according to a second embodiment of the present invention.
Figure 11:
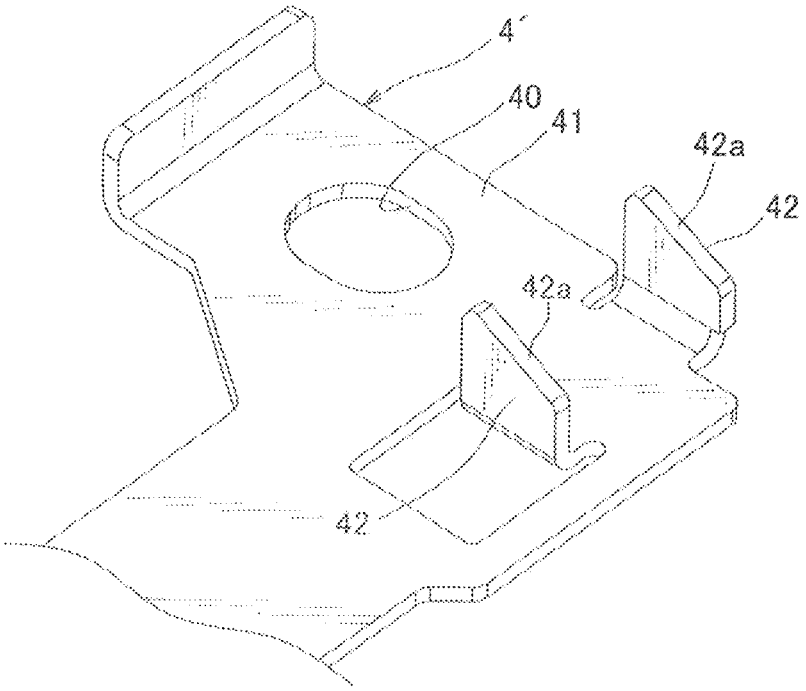
FIG. 11 is a perspective view showing only a bus bar shown in FIG. 10.
Figure 12:
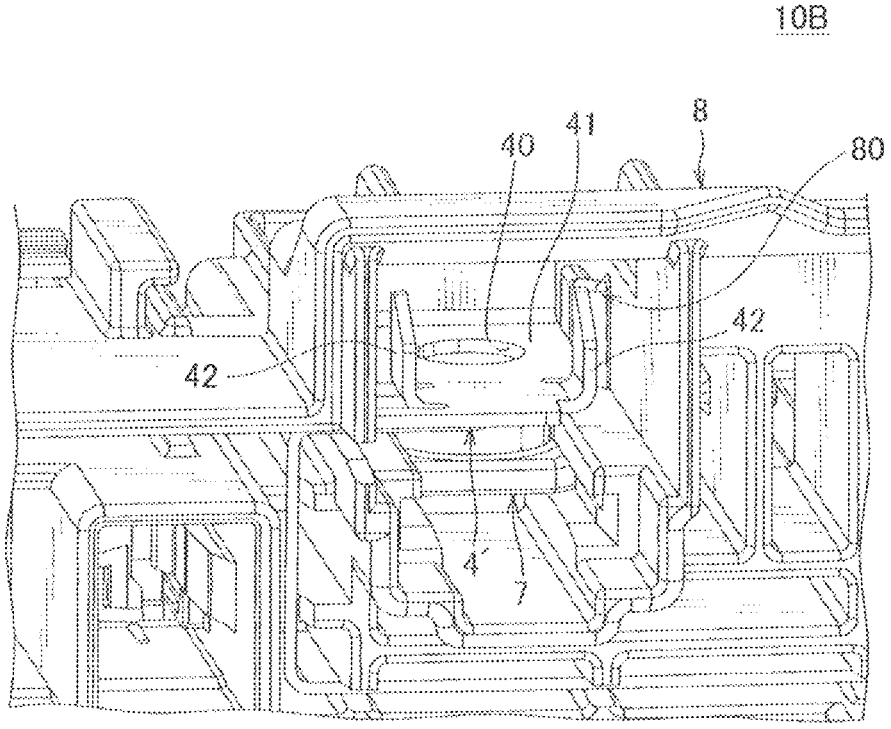
FIG. 12 is a perspective view showing a state before the round terminal is fixed to an electrical junction box using the round terminal fixation structure shown in FIG. 10 in a condition before a round terminal is fixed.
Figure 13:
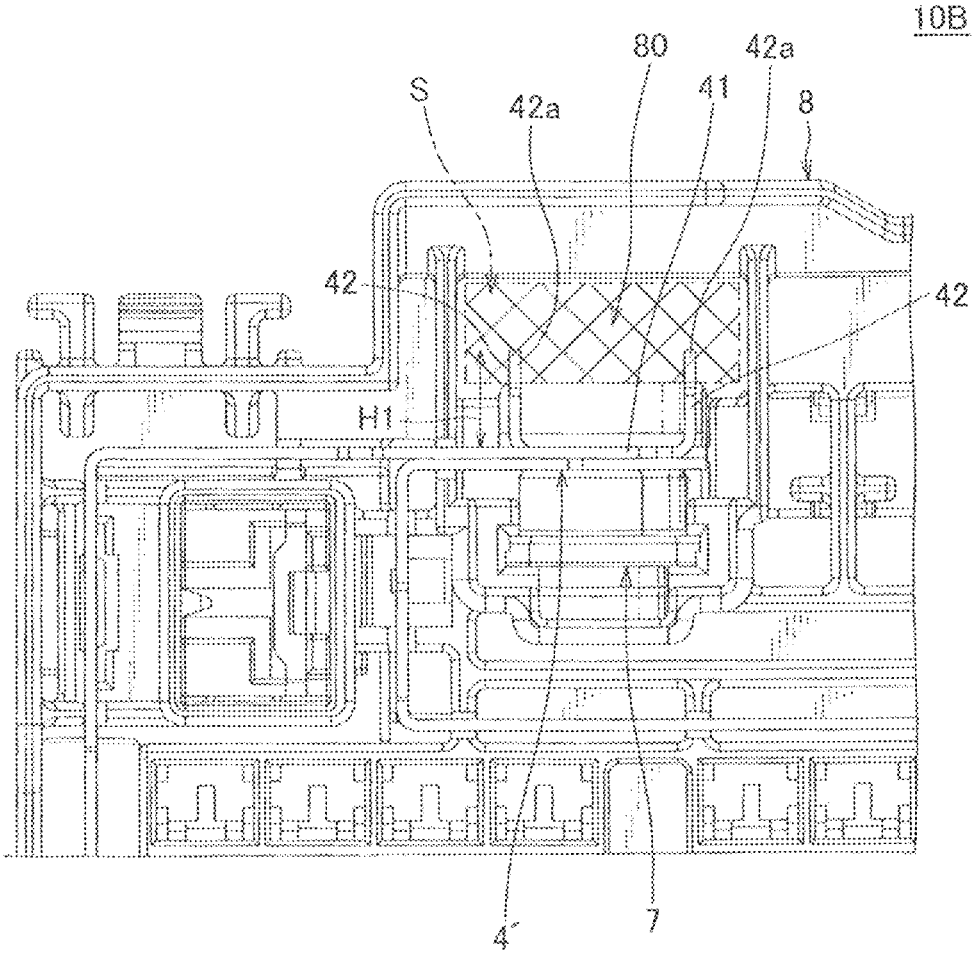
FIG. 13 is a bottom view of the electrical junction box shown in FIG. 12.

A round terminal fixation structure 1B shown in FIG. 10 is similar to the round terminal fixation structure 1A of the first embodiment, except that a bus bar 4' further includes a pair of standing pieces 42. Namely, according to this embodiment, as shown in FIGS. 11 to 14, both distal ends 42*a* of the pair of standing pieces 42 are inclined toward the flat plate portion 41 as extended away from the second through-hole 40.

Figure 14:
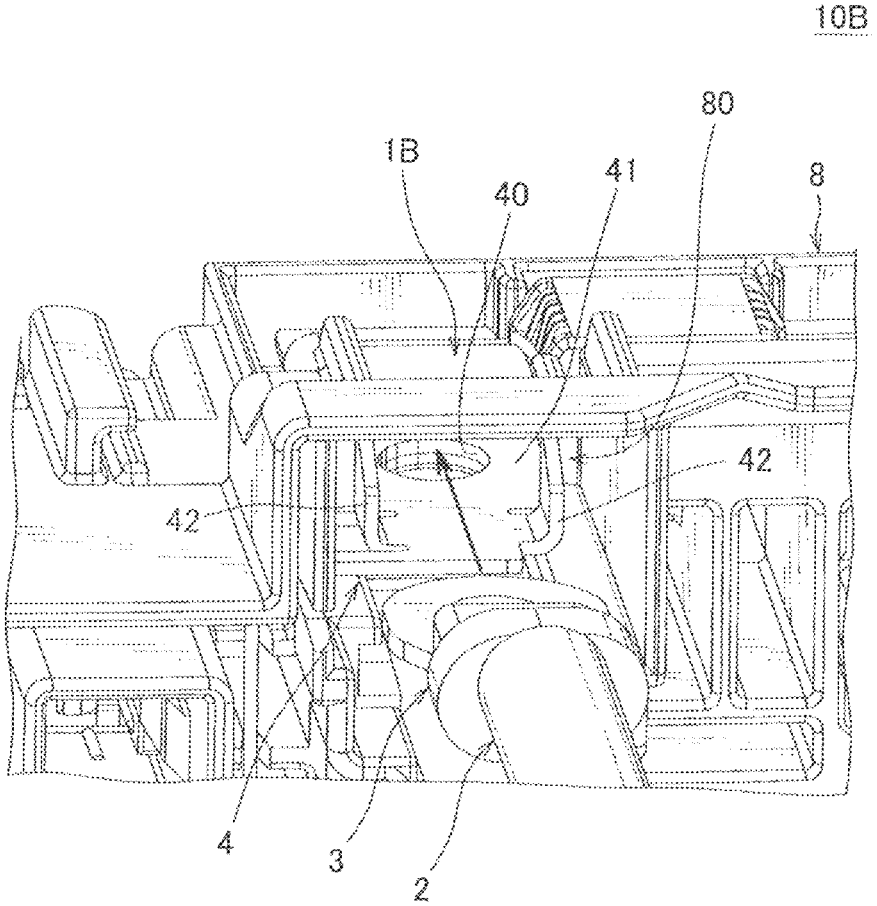
FIG. 14 is an explanatory view showing an operation of fixing the round terminal to the bus bar shown in FIG. 12.
Figure 15:
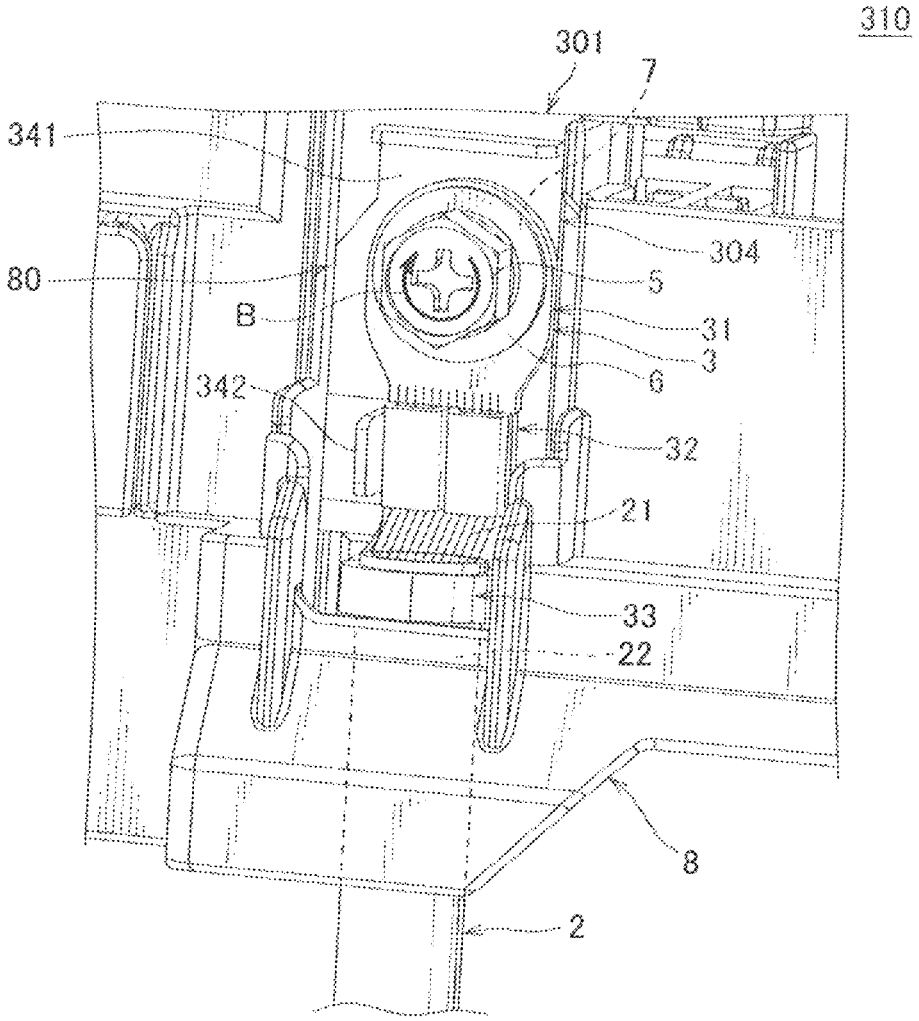
FIG. 15 PRIOR ART
FIG. 15 is a perspective view showing a main part of an electrical junction box using a conventional round terminal fixation structure.
Figure 16:
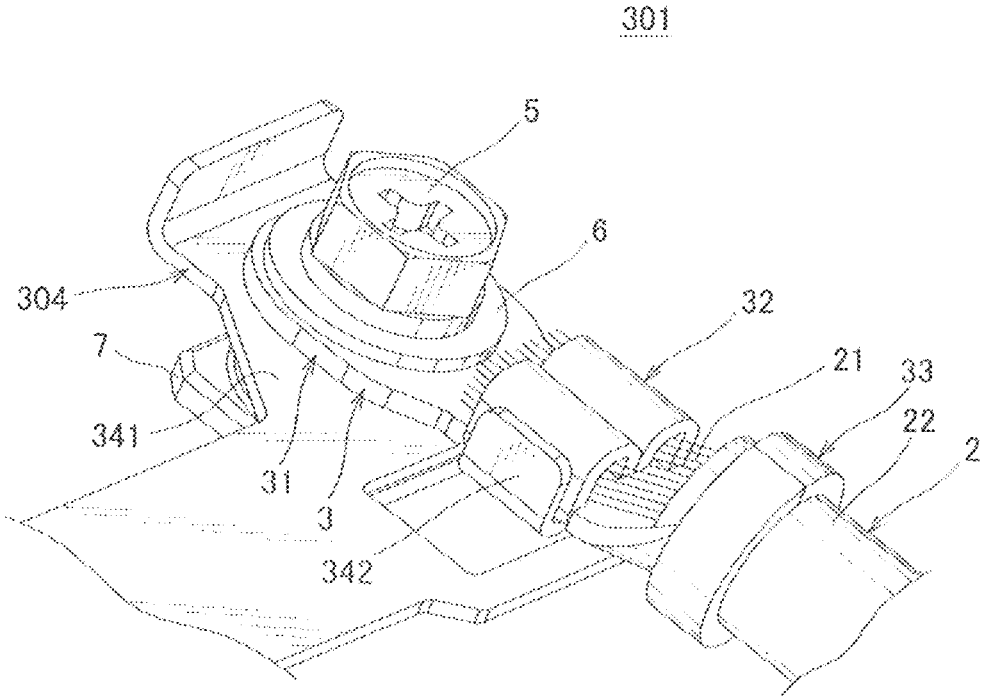
FIG. 16 PRIOR ART
FIG. 16 is a perspective view showing the round terminal fixation structure shown in FIG. 15.
Figure 17:
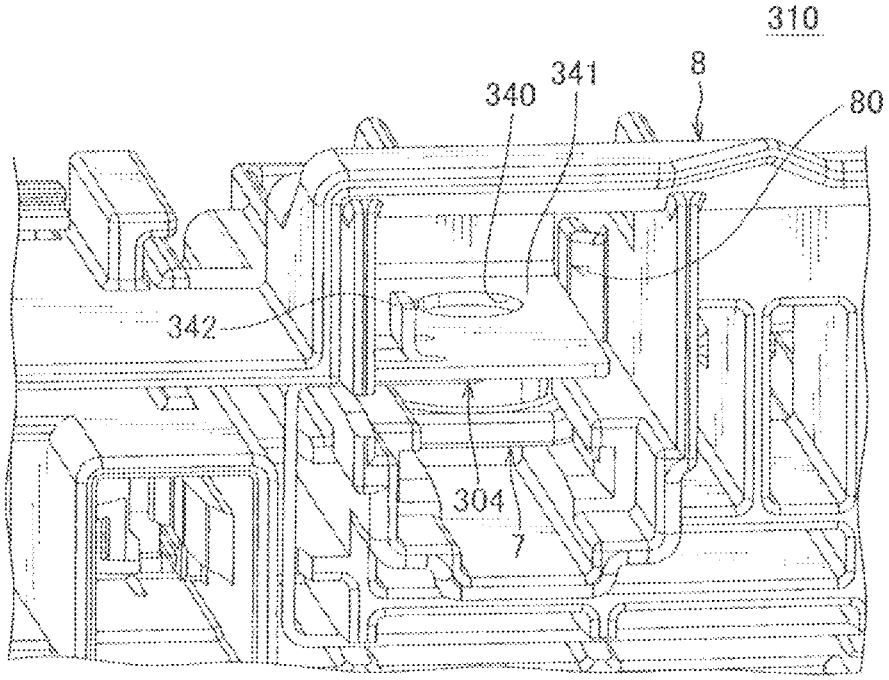
FIG. 17 PRIOR ART
FIG. 17 is a perspective view showing a state before the round terminal is fixed to the electrical junction box shown in FIG. 15.

In the above round terminal fixation structure 1B, when the round terminal 3 is fixed to the bus bar 4', an operation is performed under a following procedure. Previously the round terminal 3 is connected to an end of the electric wire 2, and as shown in FIG. 14, this round terminal 3 is inserted into the block 8, and while a rear surface of the bolt insertion portion 31 is slidably moved to the distal ends 42*a* of the pair of standing pieces 42, the bolt insertion portion 31 is moved toward the second through-hole 40. Thereby, the core wire crimp portion 32 is positioned in between the pair of standing pieces 42, and the first through-hole 30 is overlapped with the second through-hole 40. Namely, the round terminal 3 is set at the regular position. Further, when the core wire crimp portion 32 is positioned in between the pair of standing pieces 42, the round terminal 3 is moved by the height of the standing piece 42 from the distal end 42*a* toward the flat plate portion 41. Thereby, an operator obtains a feeling of catching the core wire crimp portion 32 in between the pair of standing pieces 42, and owing to this feeling, can understand that the round terminal 3 is set at the regular position. Thereby, the assembling failure is prevented. Subsequently, the bolt 5 previously inserted into a washer 6 is inserted into the first through-hole 30, the second through-hole 40, and the nut 7, and screwed to finish a fixation operation of the round terminal 3.

Further, in the above procedure, similar to the first embodiment, when inserting the round terminal 3 into the block 8, the round terminal 3 can be easily inserted without being interrupted by the standing pieces 42. Namely, because the distal ends 42*a* of the standing pieces 42 are inclined toward the flat plate portion 41 as extended away from the second through-hole 40, the round terminal 3 can be inserted from a wide space formed between the wall surrounding the terminal connection portion 80 of the block 8 and portions of the distal ends 42*a* of the standing pieces 42 located most distant from the second through-hole 40 (i.e. a space denoted by a meshed portion S in FIG. 13). Consequently, despite the large height of the standing pieces 42, the round terminal 3 can be easily set at the regular position without being interrupted by the standing pieces 42 during the insertion of the round terminal 3 into the block 8.

Furthermore, in the round terminal fixation structure 1B, occasionally, the round terminal 3 which has once been set at the regular position may be displaced before tightening the bolt 5, or the bolt 5 may be tightened while the round terminal 3 is not set at the fixation position from the beginning. For example, if the bolt 5 is accidently tightened while the round terminal 3 is located over at least one of the standing pieces 42, then, similar to the case in FIG. 9, as the belt 5 is tightened the round terminal 3 is pushed by the washer 6 and moved downward in a direction a from the second through-hole 40, thereby the round terminal 3 cannot be fixed. Consequently, in the round terminal fixation structure 1B, the round terminal 3 can be prevented from being fixed in a deformed state. Further, because the bus bar 4' and the round terminal 3 do not conduct with each other in a later continuity test, the assembling failure can be detected.

Further, according to the round terminal fixation structure of the present invention, the distal ends of the pair of standing pieces may not necessarily be inclined, and both distal ends of the pair of standing pieces may be formed flat. Namely, the bus bar includes a pair of standing pieces 43 which is explained in the first embodiment. Even in such a configuration, by positioning the core wire crimp portion 32 in between the pair of standing pieces 43, the round terminal 3 is easily set at the regular position. Further, when the core wire crimp portion 32 is positioned in between the pair of standing pieces 43, the round terminal 3 is moved by at least the height of the standing piece 43 from the distal end 43*a* of the standing piece 43 toward the flat plate portion 41. Thereby, an operator can obtain a feeling of catching the core wire crimp portion 32 in between the pair of standing pieces 43, and owing to this feeling, can understand that the round terminal 3 is set at the regular position. Thereby, the assembling failure is prevented.

The embodiments described above are only representative embodiments, and the present invention is not limited to these. Namely, the present invention can be modified and implemented in various ways without departing from the gist of the present invention.

REFERENCE SIGNS LIST

1A, 1B round terminal fixation structure
2 electric wire
3 round terminal
4, 4' bus bar
5 bolt
30 first through-hole
31 bolt insertion portion
32 core wire crimp portion
40 second through-hole
41 flat plate portion
42, 43 standing piece

What is claimed is:

1. A round terminal fixation structure comprising:

a round terminal connected to an end of an electric wire; and a bus bar to which the round terminal is configured to be fixed in an overlapping manner with a bolt, wherein the round terminal includes: a bolt insertion portion provided with a first through-hole through which the bolt is inserted; and a core wire crimp portion crimping a core wire of the electric wire, wherein the bus bar includes: a flat plate portion provided with a second through-hole through which the bolt is inserted; and a pair of standing pieces vertically extending from the flat plate portion, and configured to position the core wire crimp portion in between the pair of standing pieces while the first and second through-holes are overlapped with each other, wherein a gap between the pair of standing pieces is formed smaller than a width of the bolt insertion portion, wherein the pair of standing pieces are each formed into a quadrangular shape defined by four sides, said four sides including a first side and a second side opposite to the first side, the first side being adjacent to and parallel to the flat plate portion, and wherein the second side of one of the pair of standing pieces is entirely slanted toward the flat plate portion and at a distance from the second through-hole, and the second side of the other of the pair of standing pieces is entirely parallel to the flat plate portion and formed lower than a closest portion of the slanted second side of the one of the pair of standing pieces relative to the flat plate portion, the closest portion being closest to the flat plate portion.

2. The round terminal fixation structure as claimed in claim 1, wherein the second side of the other of the pair of standing pieces is at a distance from the second through-hole.

3. The round terminal fixation structure as claimed in claim 1, wherein the second side of each of the standing pieces is entirely offset from the flat plate portion.

* * * * *